United States Patent [19]

Kobayashi

[11] Patent Number: 4,893,054

[45] Date of Patent: Jan. 9, 1990

[54] SHADOW MASK TYPE COLOR CATHODE RAY TUBE

[75] Inventor: Hiroo Kobayashi, Nagaokakyo, Japan

[73] Assignee: Mitsubishi Denki Kabushiki Kaisha, Tokyo, Japan

[21] Appl. No.: 163,702

[22] Filed: Mar. 3, 1988

[30] Foreign Application Priority Data

Mar. 3, 1987 [JP] Japan ..... 62-49411
Mar. 10, 1987 [JP] Japan ..... 62-55911

[51] Int. Cl.[4] ..... H01J 29/81
[52] U.S. Cl. ..... 313/408; 313/477 R
[58] Field of Search ..... 313/402, 408, 477 R

[56] References Cited

U.S. PATENT DOCUMENTS

| | | | |
|---|---|---|---|
| 3,686,525 | 8/1972 | Naruse et al. | 313/402 |
| 3,721,853 | 3/1973 | Naruse et al. | 313/402 |
| 3,904,912 | 9/1975 | Duistermaat | 313/408 |
| 4,547,696 | 10/1985 | Strauss | 313/407 |
| 4,570,101 | 2/1986 | Campbell | 313/477 R X |

FOREIGN PATENT DOCUMENTS

| | | | |
|---|---|---|---|
| 0091634 | 5/1984 | Japan | 313/402 |
| 0194329 | 11/1984 | Japan | 313/402 |

OTHER PUBLICATIONS

SID 86 Digest, pp. 322–326.
Information Display, Oct. 1986, pp. 43–44.

*Primary Examiner*—Donald J. Yusko
*Assistant Examiner*—Michael Horabik
*Attorney, Agent, or Firm*—Birch, Stewart, Kolasch & Birch

[57] ABSTRACT

A color cathode ray tube which comprises a face panel including a faceplate having a phosphor screen formed of a pattern of triads of phosphor dots on an inner surface of the faceplate, the phosphor screen, and a color selecting shadow mask having a pattern of apertures for the passage of electron beams therethrough and held flat under tension by the face panel so as to confront, and spaced a predetermined distance inwardly from, the phosphor screen. At least the inner surface of the faceplate is curved so that the pitch between each neighboring apertures in the shadow mask can, while satisfying a predetermined condition relative to the distance between the inner surface of the faceplate and the shadow mask, decrease progressively away from the center of the faceplate towards a peripheral region of the faceplate.

4 Claims, 6 Drawing Sheets

SHADOW MASK TYPE COLOR CATHODE RAY TUBE

BACKGROUND OF THE INVENTION

1. Field of the Invention

The present invention generally relates to color cathode ray tubes and, more particularly, to a color cathode ray tube utilizing a flat tension shadow mask.

2. Description of the Prior Art

FIGS. 8 and 9 of the accompanying drawings are schematic reproductions of a prior art color cathode ray tube of a type disclosed in, for example, the Japanese Laid-open Patent Publication No. 61-80735, being laid open to public inspection on Apr. 24, 1986; U.S. Pat. No. 4,547,696, patented Oct. 15, 1985; SID 86 DIGEST, PAGES 322–326; and Information Display, October 1986, pages 43–44, wherein FIG. 8 is a schematic top plan view, with a portion cut away, of the prior art color cathode ray tube and FIG. 9 is a fragmentary sectional view, on an enlarged scale, of the prior art cathode ray tube shown in FIG. 8.

As shown therein, the color cathode ray tube comprises a highly evacuated glass envelope having a generally rectangular faceplate 11 and a generally rectangular frame-shaped skirt 12 bonded at 3 to the faceplate 11 by means of beads of glass frit so as to protrude from a peripheral portion of the faceplate 11, said faceplate 11 having formed on an inner surface a phosphor screen 11A which is made up of luminescent phosphor deposits which may be arranged in triads of red, green and blue phosphor dots. The envelope also has a funnel 4 having one end bonded at 14 to the skirt 12 by means of beads of glass frit and a neck 5 protruding from the opposite, tapered end of the funnel 4, the free end of said neck 5 being closed by an electrode carrier stem while a well known electron gun assembly has been installed inside the neck 5.

A color selecting shadow mask 2 having a predetermined pattern of apertures *2a* formed by the use of an etching technique, which apertures *2a* can be triads of minute holes is supported with its peripheral portion secured to the skirt 12 and is, while tensed uniformly over the entire surface area thereof, positioned so as to confront the phosphor screen 11A. With the shadow mask 2 so positioned, the apertures of the shadow mask 2 are registered with, and patterned relative to, the phosphor dots on the phosphor screen 11A so that each triad of red, green and blue electron beams emitted from an electron gun assembly and passing through a particular aperture *2a* can impinge upon the associated triad of red, green and blue phosphor dots.

When in use, the red, green and blue electron beams emitted from the electron gun assembly pass through the apertures *2a* in the shadow mask 2 and then impinge upon the phosphor screen 11A, formed on the inner surface of the faceplate 11, to cause the associated triads of phosphor deposits or dots to emit light. Considering the role of the shadow mask to shadow, i.e., mask, the phosphor screen from being scanned by the electron beams to achieve a color selection, a portion of the electron beams impinges upon a non-apertured area of the shadow mask 2 at the time the electron beams pass through the associated apertures in the shadow mask, causing the localized heating of the shadow mask 2. Consequent upon the heating of the shadow mask 2, the latter undergoes a thermal expansion with the shadow mask 2 tending to deform.

However, since the shadow mask 2 is held under tension to maintain flatness sufficient to compensate for the amount of thermal deformation thereof, the possible thermal deformation of the shadow mask can be counteracted by the tension imparted on the shadow mask, thereby to minimize any change in pitch between each neighboring apertures in the shadow mask so that any possible mislanding, i.e., incorrect landing, of the electron beams on the phosphor screen 11A can be minimized. The minimization of the mislanding of the electron beams on the phosphor screen is essential to ensure a high quality reproduction of the televised pictured on the screen.

Since the prior art color cathode ray tube referred to above is of three-piece construction wherein the faceplate 11, the skirt 12 carrying the shadow mask 2 and the funnel 4 including the neck 5 are separate from each other and bonded together to complete the envelope, the manufacture of the envelope requires separate processing steps for the molding of the faceplate 11, the skirt 12 and the funnel 4. In other words, the manufacture of the envelope for the prior art color cathode ray tube requires an increased number of processing steps not only for the glass molding, but also for the bonding of the components together, with the consequence that the productivity tends to be lowered.

As hereinabove discussed, the prior art color cathode ray tube of the construction described above brings about problems of lowering the production yield, that of the preciseness of fabrication and, hence, the reliability, and increase of the manufacturing cost.

Apart from the above discussed prior art color cathode ray tube, the cathode ray tube utilizing the flat faceplate integrally formed with the skirt by the use of a press-molding technique is also well known in the art. The use of the press-molding tends to result in the occurrence of a "suction" phenomenon, a localized buckling of the faceplate resulting from the vacuum suction which occurs when the faceplate as molded is separated from a mold assembly. As a result, the faceplate cannot be formed precisely flat.

SUMMARY OF THE INVENTION

The present invention therefore has for its essential object to provide an improved color cathode ray tube utilizing a flat tensed shadow mask, wherein the press-molding technique can be effectively utilized to fabricate the faceplate of one-piece construction together with the skirt without substantially adversely affecting the productivity, the production yield, and the precision.

Another important object of the present invention is to provide an improved color cathode ray tube of the type referred to above, wherein as a result of the use of the faceplate integral with the skirt any possible reduction in quality of televised pictures being reproduced on the screen can be advantageously minimized.

The above described and other objects and features of the present invention can be advantageously accomplished by providing a color cathode ray tube which comprises a glass face panel including a faceplate having a phosphor screen formed of a pattern of triads of phosphor dots on an inner surface of the faceplate, the phosphor screen, and a color selecting shadow mask having a pattern of apertures for the passage of electron beams therethrough and carried under tension by the glass face panel so as to confront, and be spaced a predetermined distance inwardly from, the phosphor screen. At least the inner surface of the faceplate is curved so that the pitch between each neighboring apertures in the shadow mask can, while satisfying a predetermined condition relative to the distance between the inner surface of the faceplate and the shadow mask, decrease progressively away from the center of the faceplate towards a peripheral region of the faceplate.

Specifically, in a preferred embodiment of the present invention, the inner surface of said faceplate is curved to represent a spherical shape having an equal radius of curvature in diagonal, widthwise and heightwise directions.

In another preferred embodiment of the present invention, the inner surface of said faceplate is curved to have first, second and third radii of curvature in diagonal, widthwise and heightwise directions, respectively, said first radius of curvature being greatest of all, said third radius of curvature being smallest of all, and said second radius of curvature being of a value generally intermediate between the first and third radii of curvature.

In either case, it is preferred that the pitch between each neighboring apertures in the shadow mask at a position corresponding to the peripheral region of the faceplate is chosen, in reference to the interval of the phosphor dots on the phosphor screen, to be of a value equal to or greater than 80% of that at a position corresponding to the center of the faceplate.

According to the present invention, since at least the inner surface of the faceplate is curved, the press-molding technique can advantageously be utilized to manufacture precisely the face panel of one-piece construction including the faceplate and the skirt, without being accomplished by the suction phenomenon.

The curved shape of the inner surface of the faceplate results in the correspondingly curved phosphor screen formed on the inner surface of the faceplate, and this means that the distance between the flat tensed shadow mask and the phosphor screen varies with increase of the distance from the center of the faceplate towards the peripheral region thereof, said distance being maximum at the center of the faceplate and minimum at the peripheral region thereof.

In accordance with the present invention, therefore, the pitch between each neighboring apertures in the shadow mask is so selected as to vary with increase in distance away from the center of the faceplate in correspondence with the change in distance between the shadow mask and the phosphor screen resulting the use of the curved inner surface of the faceplate, so that the phosphor dot interval and the screen pitch can satisfy the predetermined condition.

Thus, the present invention makes it possible to use the press-molding technique to make the face panel substantially free from the suction phenomenon, thereby to improve the productivity, the production yield and the preciseness of the cathode ray tube utilizing the flat tensed shadow mask. The use of the flat tensed shadow mask is advantageous in that, as discussed in connection with the prior art, any possible thermal deformation of the shadow mask can be absorbed with the mislanding of the electron beams on the phosphor screen consequently minimized.

Any possible disadvantages which would be brought about by the variation of the distance between the flat tensed shadow mask and the curved inner surface of the faceplate and, hence, the curved phosphor screen can be advantageously compensated for by suitably selecting the aperture pitch in the shadow mask that can easily and simply be achieved.

In view of the foregoing, the present invention is economical to practice in making the face panel effective to contribute to the high quality reproduction of televised image on the screen.

It is to be noted that the terms "heightwise" and "widthwise" hereinabove and hereinafter used are used to describe a particular direction of the cathode ray tube, specifically that of the faceplate, and are to be understood as meaning such particular direction as viewed from the position of a television viewer.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the drawings, like reference numerals denote like parts in the several views, and:

DETAILED DESCRIPTION OF THE EMBODIMENT

Figure 1:
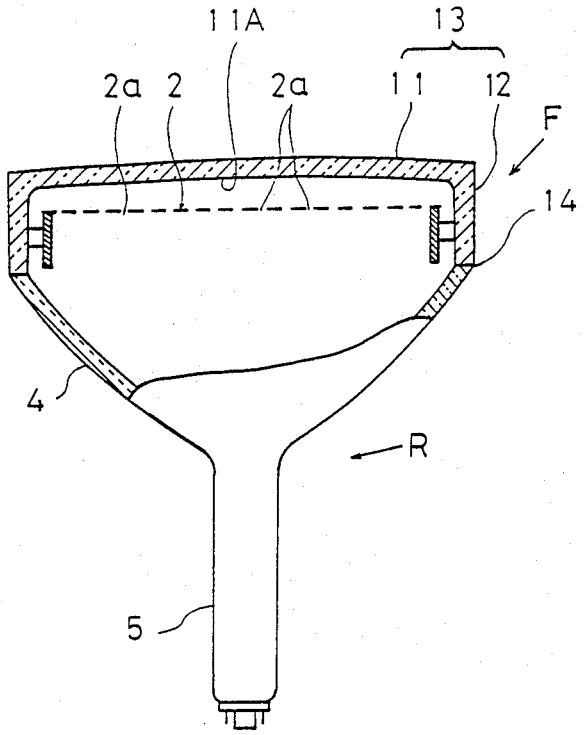
FIG. 1 is a schematic top plan view, with a portion cut away, of a shadow mask color cathode ray tube.

Before the description of the present invention proceeds, it should be noted that like parts are designated by like reference numerals throughout the several views of the accompanying drawings.

Figure 2:
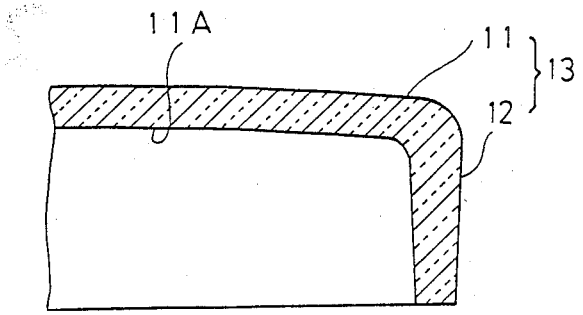
FIG. 2 is a schematic fragmentary sectional view, on an enlarged scale, of a portion of the color cathode ray tube according to one preferred embodiment of the present invention.

Referring first to FIGS. 1 and 2 showing a shadow mask color cathode ray tube according to a first preferred embodiment of the present invention, the cathode ray tube comprises a highly evacuated glass envelope of two-piece construction including front and rear bodies F and R connected hermetically together to complete the glass envelope. More specifically, the front envelope body F comprises a face panel 13 of one-piece construction having a generally rectangular faceplate 11 and a generally rectangular frame-shaped skirt 12 protruding towards the rear envelope body R from a peripheral portion of the faceplate 11, said faceplate 11 having formed on an inner surface a phosphor screen 11A which is made up of luminescent phosphor deposits which may be arranged in triads of red, green and blue phosphor dots.

On the other hand, the rear envelope body R comprises a funnel assembly of one-piece construction having a funnel 4 and a neck 5 protruding from a tapered end of the funnel 4 in a direction opposite to the front envelope body F, the free end of said neck 5 being closed by an electrode carrier stem while a well known electron gun assembly has been installed inside the neck 5. The front and rear envelope bodies F and R are bonded together at 14 by means of beads of glass frit that constitute a devitrifying glass cement of the type well known in the art, thereby completing the envelope.

The envelope of the cathode ray tube of the construction so far described may be of a type well known in the art, it being, however, to be noted that the present invention is not intended to limit the applicability thereof to the envelope wherein the front envelope body F, that is, the face panel 13, comprises two separate members, that is, the faceplate 11 and the skirt 12, provided that the disadvantages and inconveniences brought about by the manufacture are not of great significance.

Referring to the front envelope body F, and in the instance as shown in FIG. 1, the faceplate 11 has at least its inner surface (the surface where the phosphor screen 11A is formed) shaped spherically, that is, so curved as to occupy a portion of a sphere, having equal radii of curvature of the faceplate inner surface in the heightwise, widthwise and diagonal directions, respectively.

Figure 4:
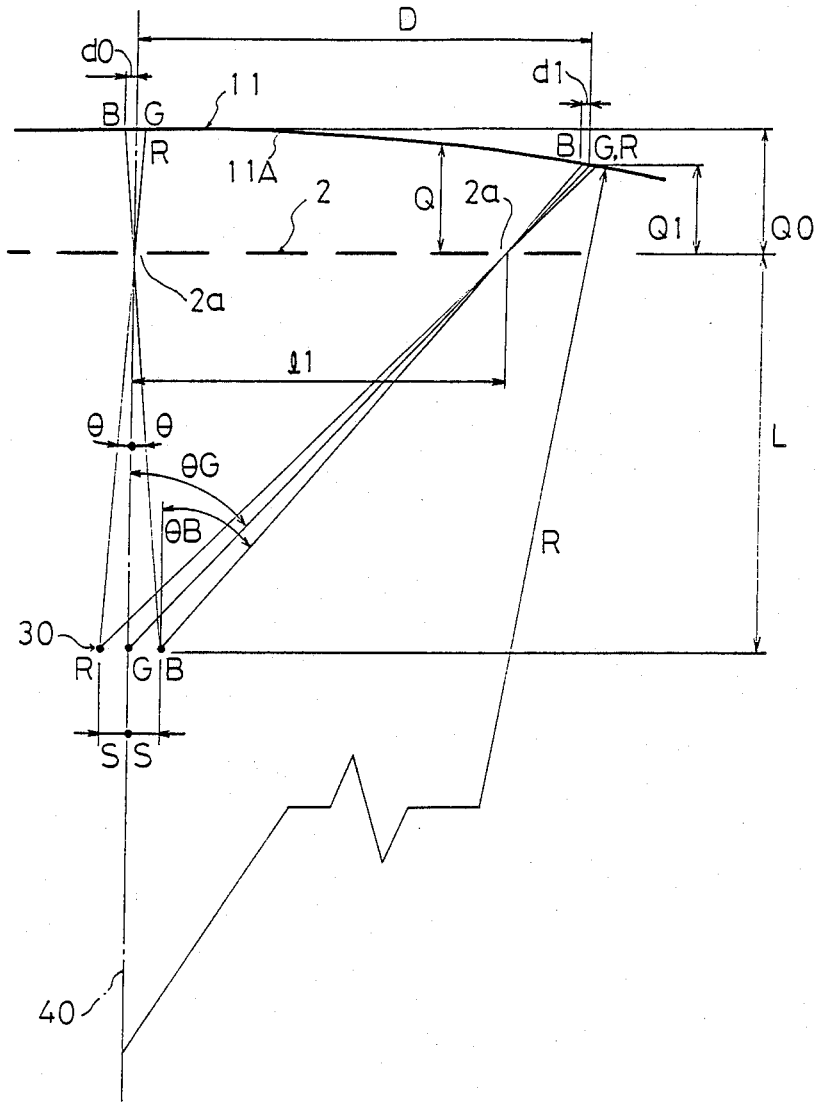
FIG. 4 is a schematic diagram used to explain the geometry of the faceplate of the color cathode ray tube in relation to electron beams.

A color selecting shadow mask 2 being held flat and having a predetermined pattern of apertures **2*a* which can be triads of minute holes is supported in any known manner with its peripheral portion secured to the skirt 12 and is, while tensed uniformly over the entire surface area thereof, positioned inside the front envelope body F so as to confront the phosphor screen 11*a*. With the shadow mask 2 so positioned, the apertures of the shadow mask 2 are registered with, and patterned relative to, the phosphor dots on the phosphor screen 11A so that each triad of red, green and blue electron beams 30 passing through a particular aperture 11A can impinge upon the associated triad of red, green and blue phosphor dots 21 as best shown in FIG. 4. For this purpose, so far as the inner surface of the faceplate 22 is spherically shaped, the pattern of the apertures 2*a* in the shadow mask 2 is so selected that the interval between each neighboring apertures 2*a* can progressively decrease in a direction radially outwardly from the center of the faceplate 11** as will now be discussed in more detail.

Figure 3:
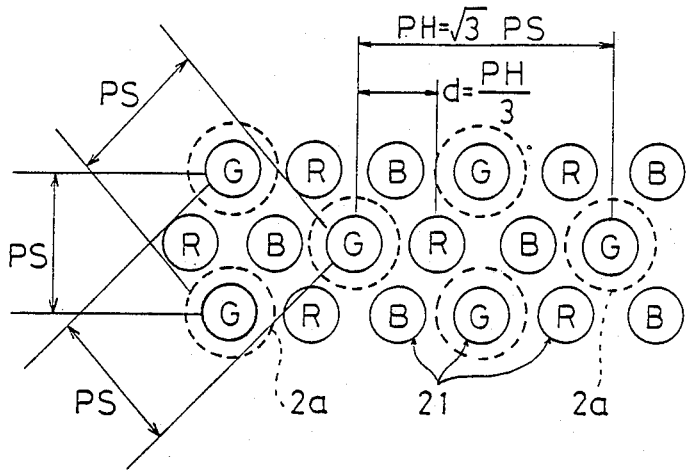
FIG. 3 is a schematic diagram showing the relationship between phosphor dots and the screen pitch with shadow mask apertures shown by phantom lines in overlapping relationship with the phosphor dots.

Referring to the shadow mask color cathode ray tube employing an in-line electron gun assembly wherein electron guns for the emission of the red, green and blue electron beams are arranged in line, the relationship between the triads of the phosphor dots 21, deposited on the inner surface of the faceplate 11 to form the phosphor screen 11A, and the so-called screen pitch PS is such that, as best shown in FIG. 3, within a space represented by the dot triad pitch, that is, the pitch between one color phosphor dot in one triad and the same color phosphor dot in the next adjacent triad in a direction parallel to the horizontal scanning line on a plane perpendicular to the axis 40 of the cathode ray tube as shown in FIG. 4, which pitch is indicated by PH and which pitch is equal to a multiple of the square root of 3 times the screen pitch PS, the red, blue and green phosphor dots 21 of each associated triad must be lined up and, at the same time, the phosphor dot interval d between one of the phosphor dots 21 of one triad and one of the phosphor dots 21 of the next adjacent triad which is closest in the horizontal scanning direction on a plane perpendicular to the axis 40 of the cathode ray tube to such one of the phosphor dots 21 of such one triad must be one third of the dot triad pitch PH.

In view of the foregoing, once the screen pitch PS, the spacing or pitch S between each neighboring electron guns for the emission of the respective red, blue and green electron beams 30, the size of the cathode ray tube and the angle of deflection at which the electron beams are deflected are fixed, design parameters such as the distance L between the point of deflection of the electron beams and the shadow mask 2 and the distance Q between the shadow mask 2 and the phosphor screen 11A in the faceplate 11 are necessarily determined with the consequence that the phosphor dot interval d0, that is, the phosphor dot interval d at the center of the faceplate 11, will be calculated by the following equation.

$$d0 = S.Q0/L = Q0 \tan\theta \quad (1)$$

wherein Q0 represents the distance Q measured between the center of the faceplate 11 and the center of the shadow mask 2.

Where the faceplate 11, or at least the inner surface of the faceplate 11, is exactly parallel to the shadow mask 2, the phosphor dot interval d0 referred to above stands for, i.e., is equal to, the phosphor dot interval d at any position on the shadow mask 2.

However, where the faceplate 11 is curved with its inner surface correspondingly curved while the shadow mask 2 is flat, the phosphor dot interval d must be progressively decreased with progressive increase of the distance away from the center of the faceplate 11 towards the periphery of the faceplate 11, or the incorrect landing of the electron beams 30 on the phosphor screen will result in as a result of misalignment between the apertures **2*a* in the shadow mask 2 and the associated triads of the phosphor dots 21**.

On the other hand, the triads of the phosphor dots 21 must satisfy the following basic design requirements of the cathode ray tube:

$$d = PH/3 \quad (2)$$

$$PH = \sqrt{3} \cdot PS \quad (3)$$

Figure 5:
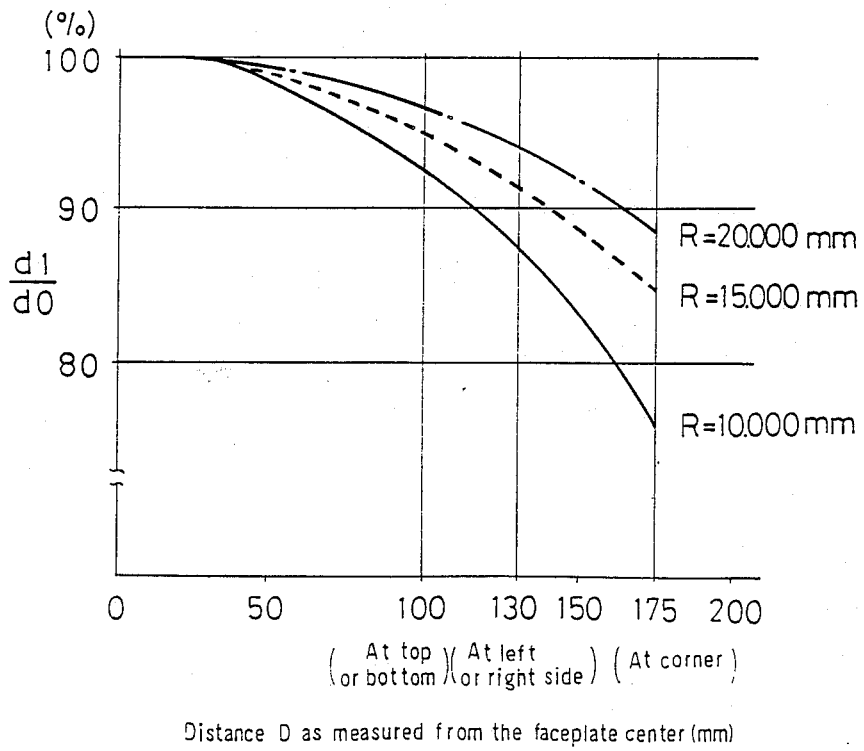
FIG. 5 is a graph showing the relationship between the radius of curvature of the faceplate of the color cathode ray tube and the interval of the phosphor dots.

The inventors of the present invention have conducted a series of experiments to determine the conditions required for, for example, a 15 inch cathode ray tube having a screen pitch of 0.31 mm at the center of the screen to satisfy the above discussed requirements when the following parameters are employed, a result of which is shown in the graph of FIG. 5.

L=184.5 mm
Q=6.5 mm

S=5.1 mm

Screen Size: (as measured from the center of the faceplate)

Diagonal Direction . . . 175 mm

Widthwise Direction . . . 130 mm

Heightwise Direction . . . 100 mm

As can be understood from the graph of FIG. 5, when the radius of curvature R of the inner surface of the faceplate 11 is chosen to be 10,000 mm, the phosphor dot interval d at the worst point, that is, at one of the diagonally spaced corner edges of the faceplate 11, is 25% smaller than the interval d0 at the center of the faceplate 11. Since the phosphor dot interval d is proportional to the screen pitch PS, the screen pitch PS must be correspondingly reduced 25% at the worst point relative to that at the center of the faceplate 11.

Similarly, where the radius of curvature R of the inner surface of the faceplate 11 is chosen to be 15,000 mm, the phosphor dot interval at the worst point is 15% smaller than the phosphor dot interval d0, and, where the radius of curvature R is chosen to be 20,000 mm, the phosphor dot interval at the worst point is 10% smaller than the phosphor dot interval d0. Accordingly, in order to minimize the reduction in quality of the reproduced picture appearing on the screen of the cathode ray tube, it is preferred that the amount of reduction in phosphor dot interval d incident to the increase of the distance away from the center of the faceplate 11 is limited to a value equal to or smaller than 20% of the phosphor dot interval d0. The radius of curvature R which satisfies this requirement falls within the range of 10,000 mm to 15,000 mm and, therefore, the minimum radius of curvature R preferred according to the present invention is 15,000 mm. In other words, according to the present invention, the faceplate 11 is preferred to have the inner surface having a radius of curvature R which is at least 15,000 mm.

However, considering the manufacture of the shadow mask by the use of glass molding, the molding of the faceplate having the flat inner surface has a problem in that it is often accompanied by the suction phenomenon. The suction phenomenon tends to constitute a major cause of reduction in flatness of at least the inner surface of the faceplate and, therefore, it is generally desirable for at least the inner surface of the faceplate to have a curved shape in any way whatsoever. In view of this, in the cathode ray tube whose faceplate has the spherical inner surface such as in the present invention, the upper limit of the radius of curvature R of the inner surface of the faceplate 11 is preferred to be 20,000 mm. If the radius of curvature R is greater than this preferred upper limit, it means that the inner surface of the faceplate becomes substantially flat and no suction will be avoided.

With the phosphor dot interval d so selected in the manner as hereinabove discussed according to the present invention, the aperture pitch of the shadow mask 2, that is, the pitch between each neighboring apertures in the shadow mask 2 has to be correspondingly chosen in such a way that the aperture pitch decreases with change in phosphor dot interval d as the distance from the center of the shadow mask increases.

Summarizing the above, it is preferred that, in the case of the 15 inch cathode ray tube, the radius of curvature R of the spherical inner surface of the faceplate should be so selected as to cause the phosphor dot interval d to satisfy the following relationship and, then, in order to avoid any possible incorrect landing of the electron beams on the phosphor screen, the aperture pitch of the shadow mask 2 should be determined in consideration of the chosen radius of curvature R.

$$d1/d0>0.8 \quad (4)$$

wherein d1 represents the phosphor dot interval d measured at a point on the phosphor screen spaced a distance D from the center of the faceplate, d0 representing the phosphor dot interval d at the center of the faceplate as defined previously. Therefore, it will readily be seen that, when the radius of curvature R of the spherical inner surface of the faceplate 11 is chosen to be within the range of 15,000 to 20,000 mm as hereinbefore discussed, the ratio of d1/d0 will result in 0.85 or greater in the instance now under discussion.

It is, however, pointed out that, for a given size of the cathode ray tube, the use of the different screen pitch PS requires change in relationship between the distance L from the point of deflection of the electron beams to the shadow mask 2 and the distance Q between the shadow mask 2 and the phosphor screen 11A on the spherical inner surface of the faceplate 11. By way of example, assuming that the pitch S between each neighboring electron guns is fixed, the increase of the screen pitch PS requires increase in the distance Q with the consequence that the ratio d1/d0 can be improved.

It is also pointed out that, since the equation (2) shows that the phosphor dot interval d is proportional to the screen pitch PS, the ratio d1/d0 of the phosphor dot interval discussed hereinabove can be considered equal to the ratio of the screen pitch PS at the center of the faceplate relative to that at a peripheral portion of the faceplate. More specifically, assuming that the screen pitch PS at the center of the faceplate is expressed by PSO and that at the peripheral portion of the faceplate 11 is expressed by PS1, the equation (4) above can be expressed as follows.

$$d1/d0=PS1/PS0>0.8 \quad (5)$$

In the foregoing embodiment shown in FIGS. 1 to 5, the faceplate 11 has been described and shown as having the spherical inner surface. However, the present invention can be equally applicable to the cathode ray tube having the faceplate itself shaped spherically. Also, the present invention can also be applicable to the cathode ray tube having the faceplate, at least the inner surface of which is so curved as to have different radii of curvature in the diagonal, widthwise and heightwise directions which will now be described in detail with reference to FIGS. 6 and 7.

Figure 6:
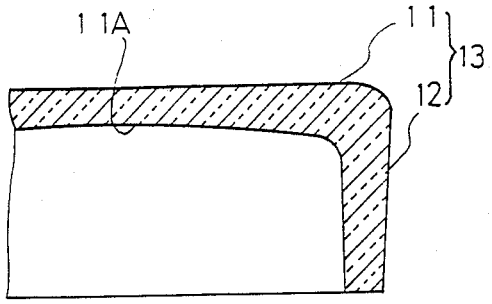
FIG. 6 is a view similar to FIG. 2, showing the color cathode ray tube according to another embodiment of the present invention.
Figure 7:
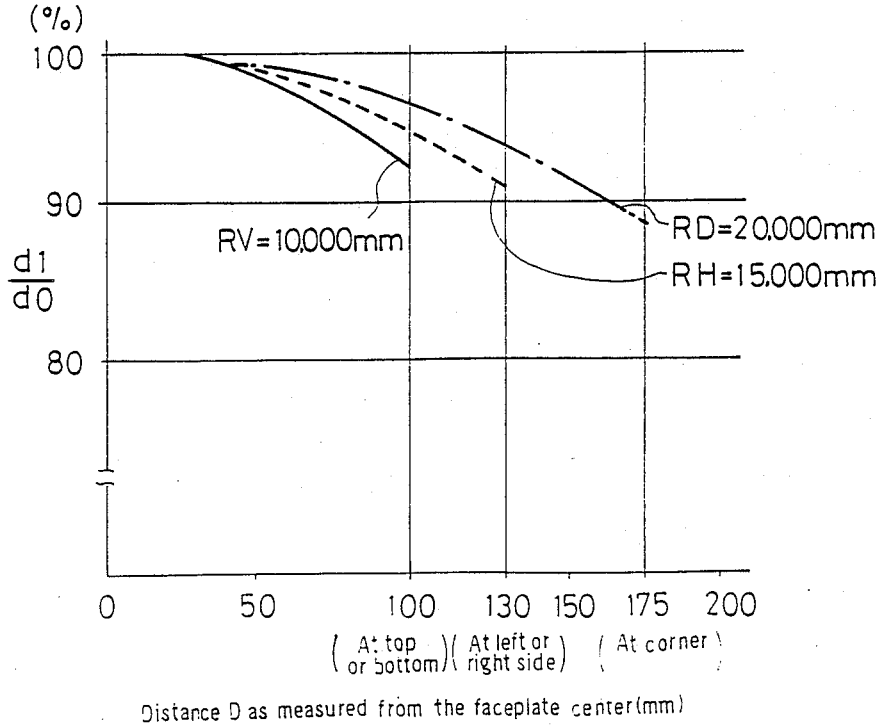
FIG. 7 is a graph similar to FIG. 5, but associated with the color cathode ray tube according to the embodiment shown in FIG. 6.
Figure 8:
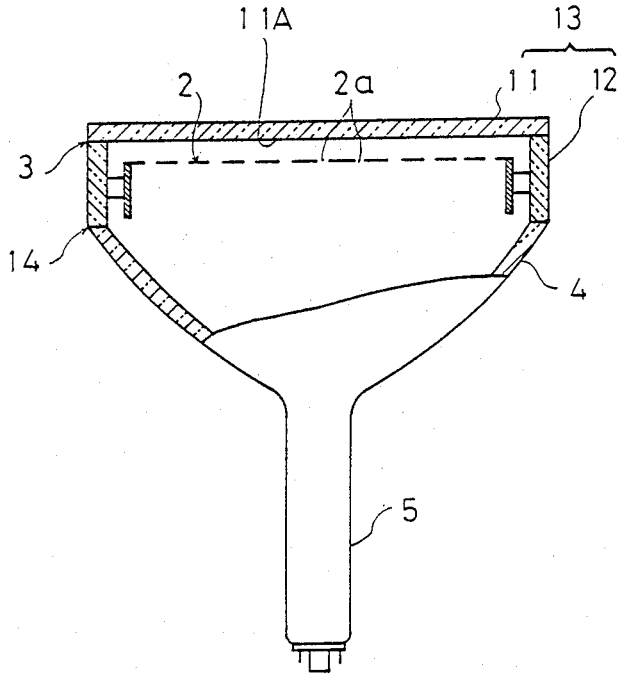
FIG.8 Prior Art
FIG. 8 is a schematic top plan view, with a portion cut away, of the prior art shadow mask color cathode ray tube.
Figure 9:
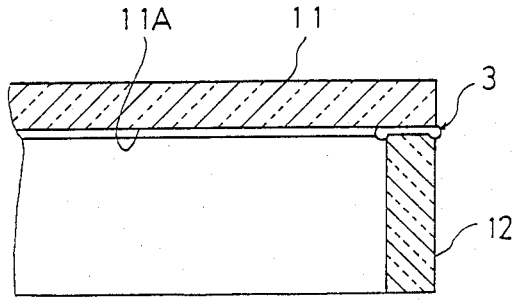
FIG.9 Prior Art
FIG. 9 is a fragmentary sectional view, on an enlarged scale, of the prior art color cathode ray tube shown in FIG. 8.
Figure 10:
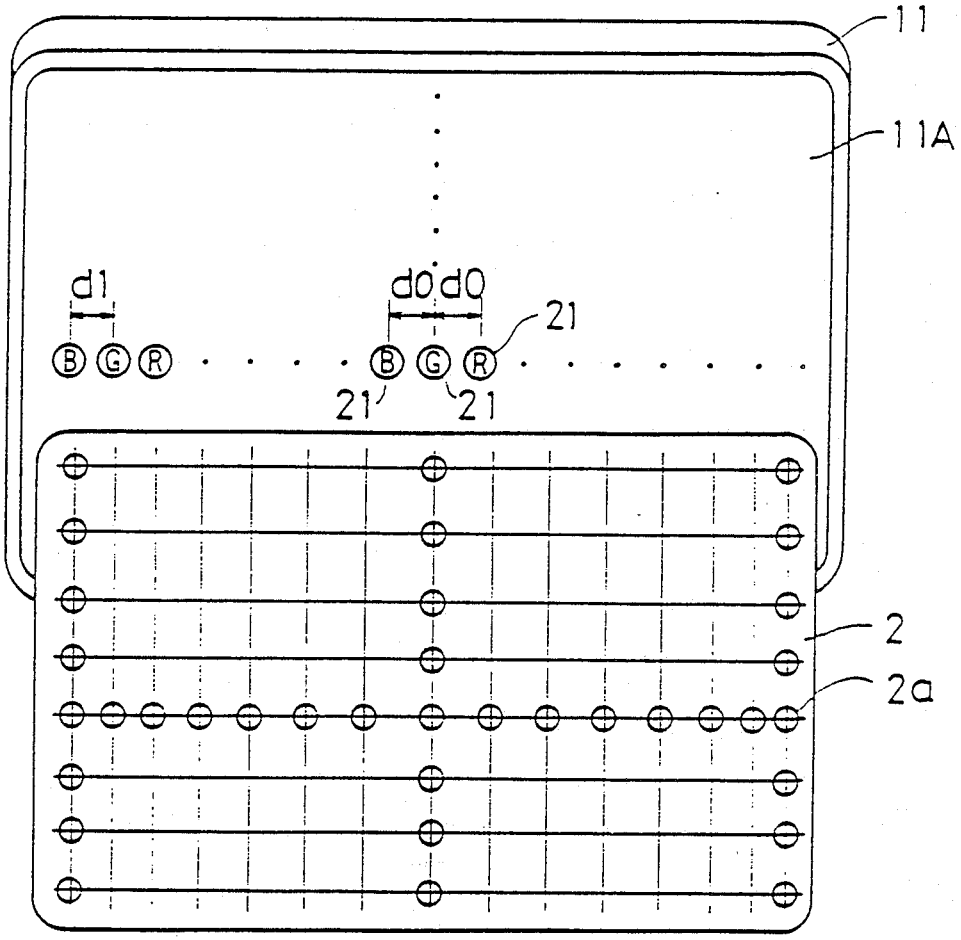
FIG. 10 is a diagram illustrating the position of the phosphor dots on the faceplate and the apertures in the shadow mask shown in FIG. 1.

According to the preferred embodiment of the present invention shown in FIGS. 6 and 7, at least the inner surface of the faceplate 11 is so curved as to have three different radii of curvature RD, RH and RV in the diagonal, widthwise and heightwise directions, respectively. In accordance with the present invention, the radii of curvature RD, RH and RV are so selected as to satisfy the following relationship with the respective curvatures at the center of the inner surface of the faceplate coinciding with each other.

$$RD>RH>RV$$

In addition, the radii of curvature RD, RH and RV have to be so chosen that the difference between these radii of curvature RD, RH and RV can satisfy the equations (4) and (5) discussed in connection with the foregoing embodiment. By way of example, assuming that the radius of curvature RV is chosen to be 10,000 mm, the radius of curvature RH is chosen to be 15,000 mm and the radius of curvature RD is chosen to be 20,000 mm, the ratio d1/d0 of the phosphor dot interval d will exhibit respective curves as shown in the graph of FIG. 7 and it will readily be seen that the ratio d1/d0 in each of the diagonal, widthwise and heightwise directions is equal to or greater than 0.8, thereby satisfying the equations (4) and (5).

Also, if the radius of curvature RV of the inner surface of the faceplate 11 in the heightwise direction is chosen to be of a value as small as possible while satisfying the equation (4) and the outer surface of the same faceplate 11 is made flat as shown in FIG. 6, the faceplate 11 can have an increased physical strength along the heightwise direction which strength is critical for a rectangular faceplate, and be reinforced, as compared with the faceplate having a uniform thickness in the heightwise direction.

The use of the flatness on the outer surface of the faceplate of the cathode ray tube as suggested in connection with the second preferred embodiment of the present invention can be applicable in the faceplate according to the embodiment shown in and described with reference to FIGS. 1 and 5.

In practice, the face panel having the faceplate, at least the inner surface of which is spherically shaped as in the first mentioned embodiment of the present invention is easier to make precisely than the manufacture of the face panel according to the embodiment of FIGS. 6 and 7, and also requires the use of a simpler mold assembly than that used in the manufacture of the face panel according to the embodiment of FIGS. 6 and 7. Therefore, the manufacture of the face panel according to the first mentioned embodiment is less costly than that according to the second mentioned embodiment, however, the most important aspect of the present invention which are accomplished by either one of the first and second mentioned embodiments lies in the high quality reproduction of televised color pictures on the screen substantially free from color blurring tending to occur at a peripheral area of the screen.

Although the present invention has fully been described in connection with the preferred embodiments thereof with reference to the accompanying drawings used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

What is claimed is:

1. A color cathode ray tube, comprising:

a face panel including a faceplate having a flat outer surface and a curved inner surface, and a phosphor screen formed of a pattern of triads of phosphor dots on said curved inner surface;

a color selecting shadow mask carried by said face panel so as to confront, and be spaced a predetermined distance inwardly from the phosphor screen, said shadow mask being held flat under tension and having a pattern of apertures defined therein for the passage of electron beams therethrough towards the phosphor screen;

said curved inner surface of said faceplate further being curved to have first, second and third radii of curvature in diagonal, widthwise and heightwise directions, respectively, said first radius of curvature being of the greatest value, said third radius of curvature being of the smallest value, and said second radius of curvature being of a value generally intermediate the value of said first and third radii of curvature; and the pitch between each neighboring aperture in the shadow mask decreasing progressively away from the center of the faceplate towards a peripheral region of said faceplate while satisfying a condition wherein the pitch is chosen, in reference to the interval of the phosphor dots on the phosphor screen in the horizontal scanning direction on a plane perpendicular to the axis of the color cathode ray tube, to have a value equal to or greater than 80% of the pitch at a position corresponding to the center of the faceplate.

2. A color cathode ray tube, comprising:

a face panel including a faceplate having a flat outer surface and a curved inner surface, and a phosphor screen formed of a pattern of triads of phosphor dots on said curved inner surface;

a color selecting shadow mask carried by said face panel so as to confront, and be spaced a predetermined distance inwardly from the phosphor screen, said shadow mask being held flat under tension and having a pattern of apertures defined therein for the passage of electron beams therethrough towards the phosphor screen;

said curved inner surface of said faceplate being curved to represent a spherical shape having an equal radius of curvature in diagonal, widthwise and heightwise directions; and the pitch between each neighboring apertures in the shadow mask decreasing progressively away from the center of the faceplate towards a peripheral region of said faceplate while satisfying a condition wherein the pitch is chosen, in reference to the interval of the phosphor dots on the phosphor screen in the horizontal scanning direction on a plane perpendicular to the axis of the color cathode ray tube, to have a value equal to or greater than 80% of the pitch at a position corresponding to the center of the faceplate.

3. A color cathode ray tube, comprising:

a face panel including a faceplate having a flat outer surface and a curved inner surface, and a phosphor screen formed of a pattern of triads of phosphor dots on a curved inner surface of said faceplate;

a color selecting shadow mask carried by said face panel confronting and being spaced a predetermined distance inwardly from the phosphor screen, said shadow mask being held flat under tension and having a pattern of apertures defined therein for the passage of electron beams therethrough towards the phosphor screen;

said curved inner surface of said faceplate being curved to have first, second and third radii of curvature in diagonal, widthwise and heightwise directions, respectively, said first radius of curvature being of the greatest value, said third radius of curvature being of the smallest value, and said second radius of curvature being of a value generally intermediate between the value of said first and third radii of curvature;

the pitch between each neighboring aperture in the shadow mask decreasing progressively away from the center of the faceplate towards a peripheral region of said faceplate; and the interval between phosphor dots of a triad also decreasing progressively away from the center of the faceplate toward said peripheral region, and wherein said interval at said peripheral region is equal to or greater than 80% of the phosphor dot interval of a triad at the center of said faceplate.

4. A color cathode ray tube, comprising:

a face panel including a faceplate having a flat outer surface and a curved inner surface, and a phosphor screen formed of a pattern of triads of phosphor dots on a curved inner surface of said faceplate;

a color selecting shadow mask carried by said face panel confronting and being spaced a predetermined distance inwardly from the phosphor screen, said shadow mask being held flat under tension and having a pattern of apertures defined therein for the passage of electron beams therethrough towards the phosphor screen;

said curved inner surface of said faceplate being curved to represent a spherical shape having an equal radius of curvature in diagonal, widthwise and heightwise directions;

the pitch between each neighboring aperture in the shadow mask decreasing progressively away from the center of the faceplate towards a peripheral region of said faceplate; and the interval between phosphor dots of a triad also decreasing progressively away from the center of the faceplate toward said peripheral region, and wherein said interval at said peripheral region is equal to or greater than 80% of the phosphor dot interval of a triad at the center of said faceplate.

* * * * *